United States Patent [19]

Okamura et al.

[11] Patent Number: 4,584,257

[45] Date of Patent: Apr. 22, 1986

[54] PHOTOGRAPHIC ELEMENTS CONTAINING NAPHTHYLSULFONYLETHYLTHIO HETEROCYCLE DEVELOPEMENT INHIBITOR PRECURSOR

[75] Inventors: Hisashi Okamura; Yoshio Sakakibara, both of Kanagawa, Japan

[73] Assignee: Fuji Photo Film Co., Ltd., Kanagawa, Japan

[21] Appl. No.: 724,057

[22] Filed: Apr. 18, 1985

Related U.S. Application Data

[63] Continuation of Ser. No. 560,361, Dec. 12, 1983, abandoned.

[30] Foreign Application Priority Data

Dec. 10, 1982 [JP] Japan ..... 57-216691

[51] Int. Cl.[4] ..... G03C 1/40; G03C 5/54; G03C 1/34

[52] U.S. Cl. ..... 430/219; 430/382; 430/445; 430/544; 430/559; 430/611; 430/957; 430/960

[58] Field of Search ..... 430/219, 382, 445, 544, 430/559, 611, 957, 960

[56] References Cited

U.S. PATENT DOCUMENTS 4,009,029 2/1977 Hammond et al. ..... 430/219
4,355,101 10/1982 Mehta et al. ..... 430/219
4,390,613 6/1983 Mehta et al. ..... 430/219

FOREIGN PATENT DOCUMENTS 3014672 11/1980 Fed. Rep. of Germany ..... 430/219
138745 10/1980 Japan ..... 430/219

*Primary Examiner*—Richard L. Schilling
*Attorney, Agent, or Firm*—Sughrue, Mion, Zinn, Macpeak and Seas

[57] ABSTRACT

A photographic element comprised of a support having provided thereon at least one silver halide emulsion layer, the element containing a development inhibitor precursor, is disclosed. The development inhibitor precursor is a compound represented by following general formula (I):

(I)

wherein A represents an unsubstituted or substituted phenyl group or a 5-membered or 6-membered nitrogen-containing heterocyclic ring; Q represents a naphthalene skeleton; $R^1$, $R^2$, and $R^3$, which may be the same or different, independently represent a hydrogen atom or a monovalent substituent; and n represents 1 or 2. The photographic element gives improved image quality particularly in the low Dmin area. The element can be processed over a wide range of different processing temperatures and has improved preservability.

9 Claims, No Drawings

PHOTOGRAPHIC ELEMENTS CONTAINING NAPHTHYLSULFONYLETHYLTHIO HETEROCYCLE DEVELOPEMENT INHIBITOR PRECURSOR

This is a continuation of application Ser. No. 560,361, filed Dec. 12, 1983, now abandoned.

FIELD OF THE INVENTION

This invention relates to a photographic element and particularly, to a photographic element using a development inhibitor precursor. More particularly, the invention relates to a color diffusion transfer photographic element using a development inhibitor precursor.

BACKGROUND OF THE INVENTION

U.S. Pat. Nos. 3,260,597 and 3,265,498 disclose controlling the density of a Dmin range referred to as "fog" by using a development inhibitor or a development inhibitor precursor in a color diffusion transfer photographic element.

However, the compounds illustrated in these patents inhibit not only unnecessary development but also the necessary development, thereby reducing image quality. Furthermore, temperature greatly influences the photographic development reaction. That is, the development proceeds slowly at low temperature and proceeds quickly at high temperature. Accordingly, excessive development is, particularly, liable to occur at high temperature. Therefore, it has been desired to discover a development inhibitor precursor which inhibits the occurrence of unnecessary development at about room temperature, controls the development so that the necessary development is not disturbed, and expands the allowable range of the processing temperature by controlling the occurrence of an excessive development at high temperature.

U.S. Pat. No. 4,009,029 (Hammond et al) discloses a development inhibitor precursor for this purpose.

On the other hand, various photographic additives used in photographic elements or the reaction products thereof must not have undesirable effects such as reducing the image quality of the photographic elements before and after processing the photographic elements. The compounds, such as 5-(2-cyanoethylthio)-1-phenyltetrazole, as described in the foregoing U.S. Pat. No. 4,009,029, form harmful compounds, which promote the collapse of certain kinds of image-forming dyes, by processing photographic elements containing them. When the additives forming such harmful compounds exist in photographic elements, the density of color images is reduced with the passage of time after processing which reduces image quality.

When these additives are incorporated in a cover sheet of a photographic unit, they must not reduce the pH controlling function of the cover sheet. When the additives described in, for example, Japanese Patent Publication (Unexamined) No. 138745/80 are incorporated in a cover sheet or the cover sheet containing these additives is preserved for a long period of time, the reducing function of pH is greatly impaired, whereby the pH in the system is kept high for an extraordinarily long period of time. This phenomenon sometimes gives bad influences such as the reduction of sharpness of images on the photographic element.

Accordingly, it has been desired to discover a development inhibitor precursor which can properly control development, has a wide allowable range of processing temperature, and does not impair the pH controlling function of a cover sheet without reducing the image quality of color images after processing.

SUMMARY OF THE INVENTION

An object of this invention is to provide a novel development inhibitor precursor.

Another object of this invention is to provide a photographic element comprising a support having provided thereon at least one photosensitive silver halide emulsion layer, which contains a novel development inhibitor precursor associated therewith.

Still another object of this invention is to provide a color diffusion transfer photographic element giving color images having improved image quality (in particular, low Dmin).

A further object of this invention is to provide a color diffusion transfer photographic element having a wide allowable range of processing temperature.

Another object of this invention is to provide a color diffusion transfer photographic element having improved preservative stability after processing.

A still further object of this invention is to provide a development inhibitor precursor which does not impair the pH controlling function of a cover sheet.

As the result of various investigations, the inventors have discovered that the foregoing objects of this invention can be attained by using a novel development inhibitor precursor represented by following general formula (I):

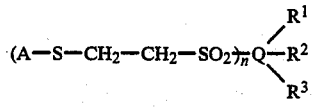

$$(A-S-CH_2-CH_2-SO_2)_n Q \begin{matrix} R^1 \\ R^2 \\ R^3 \end{matrix} \quad (I)$$

wherein A represents an unsubstituted or substituted phenyl group or a 5-membered or 6-membered nitrogen-containing heterocyclic ring; Q represents a naphthalene skeleton; $R^1$, $R^2$, and $R^3$, which may be same or different, independently represent a hydrogen atom or a monovalent substituent; and n represents 1 or 2.

That is, according to this invention, there is provided a photographic element comprising a support having provided thereon at least one photosensitive silver halide emulsion layer, which contains the development inhibitor precursor shown by foregoing general formula (I) associated therewith.

DESCRIPTION OF THE PREFERRED EMBODIMENT

In general formula (I), A represents an unsubstituted or substituted phenyl group or a 5-membered or 6-membered nitrogen-containing heterocyclic ring.

Examples of the substituent for the substituted phenyl group shown by A are an alkyl group (preferably, an alkyl group having 1 to 4 carbon atoms, e.g., a methyl group, an ethyl group, etc.), an alkoxy group (preferably, an alkoxy group having 1 to 4 carbon atoms, e.g., a methoxy group, an ethoxy group, etc.), a nitro group, a halogen atom (e.g., a chlorine atom, etc.), an alkoxycarbonyl group (in which the alkyl moiety thereof preferably has 1 to 4 carbon atoms, e.g., a methoxycarbonyl group, an ethoxycarbonyl group, etc.), an unsubstituted or substituted carbamoyl group (in which the substituent thereof is preferably an alkyl group having 1 to 4 carbon atoms, a phenyl group, etc.), and an unsubstituted or substituted sulfamoyl group (in which the substituent thereof is preferably an alkyl group having 1 to 4 carbon atoms, a phenyl group, etc.).

The nitrogen-containing heterocyclic ring shown by A may be fused with a benzene ring, etc., or may be substituted by an ordinary substituent (e.g. a phenyl group, etc.). Examples of the nitrogen-containing heterocyclic ring are tetrazole rings such as a tetrazole ring, a phenyltetrazole ring, etc.; triazole rings such as a benzotriazole ring, a 1,2,4-triazole ring, etc.; diazole rings such as a benzimidazole ring, an imidazole ring, etc.; pyrimidine rings such as a pyrimidine ring, etc.; and monoazole rings such as a benzothiazole ring, a benzoxazole ring, etc. Preferred are nitrogen-containing heterocyclic rings having at least two different atoms, such as tetrazole rings, benzotriazole rings, and benzothiazole rings, with the tetrazole rings, especially a phenyltetrazole ring, being particularly preferred.

In a preferred embodiment of this invention, the photographic element of this invention is a color diffusion transfer photographic element having at least one photosensitive silver halide emulsion layer having a dye image-forming compound associated therewith, a support for supporting the silver halide emulsion layer and an image-receiving layer, which photographic element contains a development inhibitor precursor, the development inhibitor precursor being the compound shown by foregoing general formula (I).

In another preferred embodiment of this invention, the photographic element containing the development inhibitor precursor shown by general formula (I) is a color diffusion transfer photographic element comprising a support, a photosensitive element having at least one silver halide emulsion layer and a dye image-forming compound associated therewith, and an image-receiving element fixing a diffusible dye formed from the dye image-forming compound to form an image; and further comprising other hydrophilic colloid layers, if desired, an alkaline processing composition capable of developing the exposed photosensitive element, and a neutralizing means for neutralizing the alkaline processing composition, if desired.

In still another preferred embodiment of this invention, the photographic element of this invention containing the development inhibitor precursor shown by general formula (I) is a color diffusion transfer photographic element including a photosensitive sheet comprising a transparent support having provided thereon an image-receiving element for fixing a diffusible dye to form an image, a white reflecting layer, a light-shielding layer, and a photosensitive element containing at least one silver halide emulsion layer having a dye image-forming compound associated therewith; an alkaline processing composition capable of developing the exposed photosensitive element; and a cover sheet comprising another support having provided thereon a neutralizing means for neutralizing the alkaline processing composition.

The compounds of general formula (I) will now be explained in more detail.

Preferred 5-membered or 6-membered nitrogen-containing heterocyclic ring shown by A in general formula (I) is a compound represented by general formula (II):

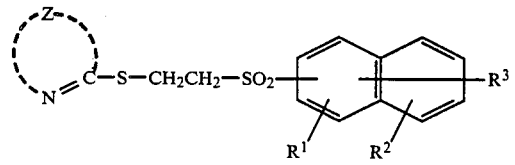

(II)

wherein Z represents a non-metallic atomic group necessary for completing a 5-membered or 6-membered heterocyclic ring, preferably a substituted tetrazole ring, more preferably a phenyltetrazole ring, and $R^1$, $R^2$, and $R^3$, which may be the same or different, independently represent a hydrogen atom or a monovalent substituent.

Examples of the monovalent substituent are a halogen atom (e.g., a fluorine atom, a chlorine atom, a bromine atom, etc.); a hydroxy group; a nitro group; a cyano group; an unsubstituted or substituted alkoxy group in which the alkyl moiety thereof may be straight or branched chain [preferably those having 1 to 18 carbon atoms (e.g., those having 1, 2, 3, 4, 5, 6 or 12 carbon atoms which may be straight, secondary or tertiary); examples of the substituent in the substituted alkoxy group are those alkoxy groups as described above and an aryl group; and examples of an aryl group-substituted alkoxy group which is one example of the substituted alkoxy group are a benzyloxy group, etc.]; an unsubstituted for substituted alkylsulfonyl group in which examples of the unsubstituted alkyl moiety thereof are a methyl group, an ethyl group, a propyl group, etc., and examples of the substituted alkyl moiety thereof are a trifluoromethyl group, a benzyl group, etc.; an unsubstituted or substituted arylsulfonyl group in which examples of the unsubstituted aryl moiety thereof are a phenyl group, etc., and examples of the substituted aryl moiety thereof are a tolyl group, etc.; an unsubstituted or substituted amino group in which examples of the substituent thereof are an acyl or alkyl group (preferably those having 1 to 18 carbon atoms), etc.; a carbamoyl group; a sulfamoyl group; a carboxy group; an unsubstituted or substituted alkyl group which may be straight or branched chain (preferably, those having 1 to 30 carbon atoms; an unsubstituted or substituted aryl group (e.g., a phenyl group, a naphthyl group, etc.); and an unsubstituted or substituted aralkyl group (e.g., a benzyl group, a phenethyl group, etc.).

The total carbon atom number included in $R^1$, $R^2$, and $R^3$ is preferably at least 4. More preferably, the moiety constituted by $R^1$, $R^2$, $R^3$ and the naphthalene ring is one for imparting a non-diffusible property to the compound of general formula (II) or the residual portion of the compound formed when the compound is split by development to release a silver halide development inhibitor, before and after the development.

Examples of the substituent for the foregoing alkyl group, aryl group, and aralkyl group are a halogen atom (e.g., a chlorine atom, a fluorine atom, etc.), a hydroxy group, an alkoxy group (preferably, one having 1 to 8 carbon atoms (e.g., a methoxy group, etc.), and an amino group.

The development inhibitor precursor useful in this invention splits in an alkaline solution to release a development inhibitor capable of diffusing in the alkaline solution.

Typical examples of the useful development inhibitor precursor used in this invention are as follows.

Compound 1
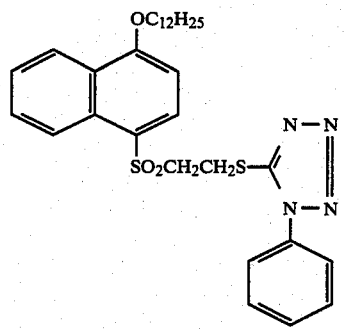
Compound 2
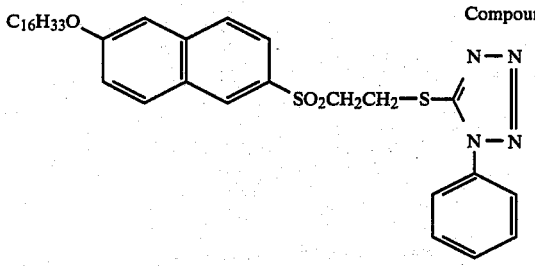
Compound 3
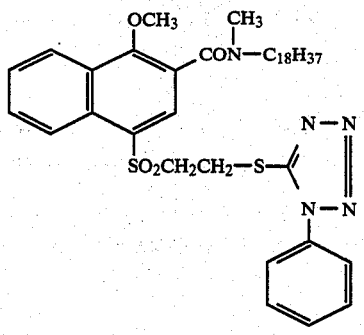
Compound 4
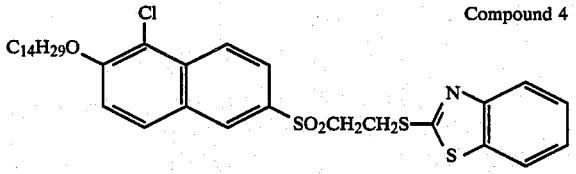
Compound 5
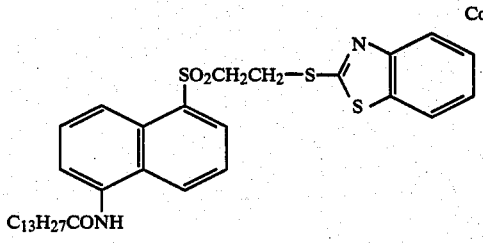
-continued
Compound 6
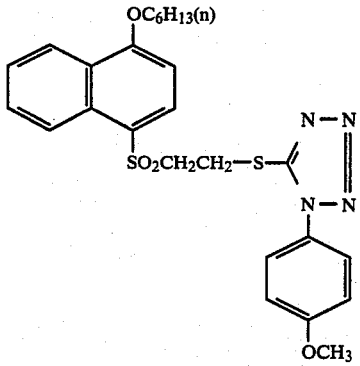
Compound 7
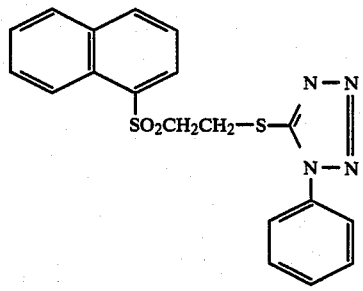
Compound 8
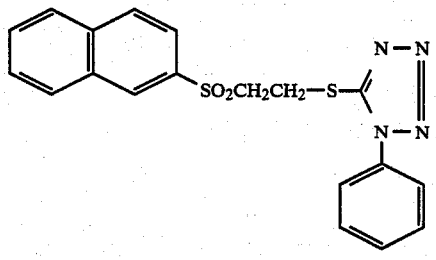
Compound 9
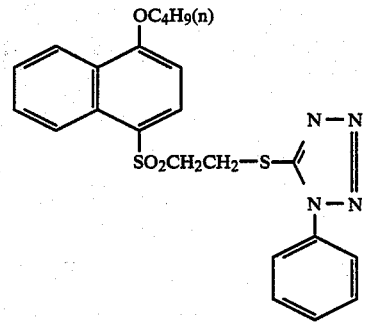
Compound 10
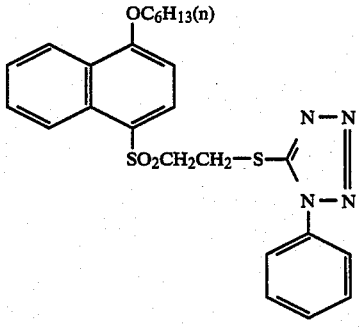
Of these compounds, Compounds 1, 6, 7, 8, 9, and 10 are preferred.

Synthesis examples of these compounds are shown below.

Synthesis of Compound 1:

In a three-necked flask equipped with a stirrer, a Dimroth condensor, and a thermometer were placed 21.4 g of 1-phenyl-5-mercaptotetrazole, 24.2 g of 1-dodecyloxy-4-vinylsulfonylnaphthalene, 10.0 g of sodium acetate, and 150 ml of acetic acid, and the mixture was stirred for 3 hours at an inside temperature of 80° C. in an oil bath. After allowing the reaction mixture to cool, the mixture was transferred to a one liter separatory funnel, and after adding thereto 300 ml of ethyl acetate, the mixture was washed three times with 200 ml of water. Then, anhydrous magnesium sulfate was added to the ethyl acetate solution thus formed, and after drying, the mixture was concentrated under reduced pressure. The residue was recrystallized from one liter of ethanol to provide Compound 1. The yield of the product was 24.5 g, which was 70% of the theoretical value. The melting point was 81° to 82° C. The structure of the product was confirmed by the NMR spectra, IR spectra, and MS spectra, respectively.

Other development inhibitor precursors in this invention can also be prepared in the manner described above.

Various methods for preparing the vinylsulfone compounds used as the starting material for producing the development inhibitor precursors are known. A method for preparing 1-dodecyl-4-vinylsulfonylnaphthalene which is a starting material for Compound 1 of the invention is schematically shown below:

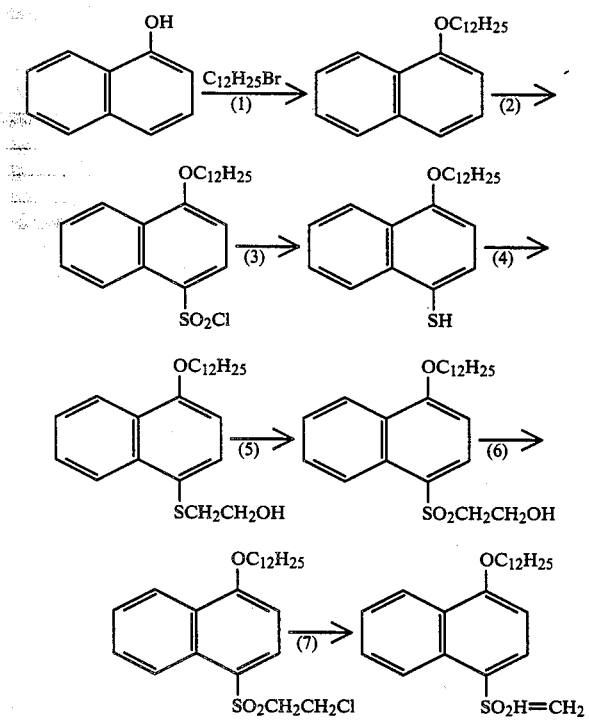

The reaction in the foregoing steps are performed by referring to the following literatures. Step (1): S.R. Sandler and W. Karo, *Organic Functional Group Preparation,* pages 101–102; step (2): ibid., pages 508–512 and 517; step (3): *Organic Synthesis,* Collective Volume 1, page 504; step (4): S. R. Sandler and W. Karo, *Organic Functional Group Preparation,* pages 486–487; step (5): ibid., pages 501–502; step (6): ibid., pages 118–123; and step (7) ibid., page 43.

The compounds of this invention show very low deterioration action to the images after processing as compared to the compounds described in, for example, U.S. Pat. No. 4,009,029 and Japanese Patent Publication (Unexamined) No. 138745/80. That is, the compounds of this invention provide color prints having improved preservation characteristics. Such characteristics which result from the compounds of this invention were not anticipated and are very astonishing since the chemical structures of the compounds are very similar to those of the known compounds. It is believed that at least one of the advantages is obtained when the compound releases a development inhibitor by alkaline processing so that the residual reaction product is reluctant to diffuse as compared to those of the known compounds and has a far low reactivity to the resulting dye images.

When the compound of this invention is associated with a cover sheet, the compound does not impair the pH controlling function nor does it impart the pH controlling function after preserving under severe conditions as takes place when using the compounds described in foregoing Japanese Patent Publication (Unexamined) No. 138745/80. In other words, the compound of this invention does not have undesirable influences or reduce the stability of the cover sheet with the passage of time.

The development inhibitor precursors of this invention can be advantageously used for photographic materials having ordinary silver halide emulsion layers in addition to the foregoing diffusion transfer photographic elements. When the compound of this invention is associated with such an ordinary photographic material, the compound is stable, gives almost no reduction in photographic properties during the preservation of the photographic material, does not reduce the sensitivity of the photographic material at light exposure, and releases a mercapto compound, which acts as an antifoggant, during development to effectively reduce the formation of fog. Furthermore, the compound of this invention can prevent the occurrence of fog in quick development using silver halide emulsions having high developing speed, silver halide emulsions associated with development accelerators or couplers having a high reactivity, developers having a high pH, or a high developing temperature.

The color diffusion transfer photographic element of this invention may further use a neutralization timing layer usually known in the art.

Useful materials for such a timing layer include a polymer having a low alkali permeability, such as polyvinyl alcohol, cellulose acetate, partially hydrolyzed polyvinyl acetate, etc.; a polymer prepared by copolymerizing a small amount of a hydrophilic comonomer such as an acrylic acid monomer; a polymer having a lactone ring; and the like.

Particularly useful materials for the timing layer are the cellulose acetates as disclosed in Japanese Patent Publication (Unexamined) Nos. 136328/79 and 130926/79, U.S. Pat. Nos. 4,009,030 and 4,029,849, etc.; the polymers prepared by copolymerizing a small amount of a hydrophilic comonomer such as acrylic acid, etc. as disclosed in Japanese Patent Publication (Unexamined) Nos. 145217/77, 72622/78, 78130/79, 138433/79, 138432/79 and 128335/79, U.S. Pat. No. 4,061,496, etc.; and the polymers having a lactone ring as disclosed in Japanese Patent Publication (Unexamined) No. 54341/80 and *Research Disclosure,* No. 18, 452 (1979).

Other materials used for the timing layer in this invention are also disclosed in U.S. Pat. Nos. 3,455,686, 4,009,030, 3,785,815 and 4,123,275, Japanese Patent Publication (Unexamined) Nos. 92022/73, 64435/74, 22935/74, 77333/76, 2431/77 and 88330/77, Japanese Patent Publication Nos. 15756/69, 12676/71 and 41214/73, West German Offenlegungschrift Nos. 1,622,936 and 2,162,277, and *Research Disclosure,* 15,162, No. 151 (1976).

A development inhibitor can be released from the development inhibitor precursor of this invention by contacting the precursor with an alkaline medium, but splitting of the development inhibitor precursor can be achieved or accelerated by increasing the temperature.

The development inhibitor precursor of this invention is innert with respect to silver halide emulsions and changes very little even under severe preservative condition applied to the photographic materials.

When the photographic element of this invention is applied to a color diffusion transfer photographic process, the photographic element may have a constitution of a peel-apart type film unit; an integrated type film unit as disclosed in Japanese Patent Publication Nos. 16356/71 and 33697/73, Japanese Patent Publication (Unexamined) No. 13040/75, and British Pat. No. 1,330,524; and a peeling-unnecessary type film unit as disclosed in Japanese Patent Publication (Unexamined) No. 119345/82.

With all these types of film units, it is desirable to increase the allowable range of a processing temperature to use a polymer layer protected by a neutralization timing layer.

In a preferred embodiment of this invention, the photosensitive element is comprised of a support having provided thereon at least one layer containing a silver halide emulsion and has the development inhibitor precursor shown by foregoing general formula (I) so that the precursor can effectively act.

In a very preferred embodiment of this invention, the photographic element of this invention includes:

(1) a photosensitive layer containing at least one silver halide emulsion layer having a dye image-forming compound associated therewith, (2) an image-receiving layer, (3) a means for releasing an alkaline processing composition containing a silver halide developing agent, (4) a neutralizing means including a neutralizing layer having, if desired, a neutralization timing layer associated therewith, and (5) the development inhibitor precursor shown by foregoing general formula (I) added so that the precursor effectively acts on the development of the foregoing silver halide emulsion layer.

If the development inhibitor precursor shown by foregoing formula (I) is associated so that the precursor effectively acts on the development of the silver halide emulsion, the precursor may be incorporated in any layer or layers but is preferably incorporated in a photosensitive layer such as a layer containing a silver halide emulsion, a layer containing a dye image-forming compound, and other auxialiary layers; an image-receiving layer or an auxialiary layer such as a white reflecting layer; or a neutralizing means such as a neutralizing layer or a neutralization timing layer. It is particularly preferred that the development inhibitor precursor be incorporated in a neutralizing layer or a neutralization timing layer.

The amount of the foregoing development inhibitor precursor added in a diffusion transfer photographic process depends upon the amount of developer, development conditions, the formulation of the silver halide emulsion layer, etc. and cannot be unequivocally defined. But it is usually at least $10^{-5}$ mol, preferably $10^{-4}$ to $10^{-1}$ mol, per mol of silver in the silver halide emulsion layer or layers.

The development inhibitor precursor may be incorporated in a desired layer by a technically applicable effective method. In a preferred embodiment, the development inhibitor precursor can be added to a coating composition of a desired layer as a solution in an organic solvent such as acetone, etc., or may be dissolved in a high boiling solvent such as a water-insoluble coupler solvent, and then added to a coating composition as an emulsified dispersion of the solution in a carrier medium. Typical examples of the useful coupler solvent are proper polar solvents such as liquid dye stabilizers as described in the article entitled "Improved Photographic Dye Image Stabilizer-Solvent" in *Product Licensing Index,* Vol. 83, March, 1971, tri-o-cresyl phosphate, di-n-butyl phthalate, diethyllaurylamide, 2,4-diarylphenyls, etc.

In another preferred embodiment, the development inhibitor precursor is directly dissolved in a coating composition using an organic solvent for a neutralizing layer, a neutralization timing layer, etc. when coating the coating composition.

Various addition methods for the development inhibitor precursor were described above but other methods may also be employed without being restricted to the foregoing methods.

The photosensitive silver halide emulsion used in this invention is a hydrophilic colloidal dispersion of silver chloride, silver bromide, silver chlorobromide, silver iodobromide, silver chloroiodo-bromide or a mixture of them. The halogen composition is selected according to the use and processing condition of the photographic material but the halogen composition as silver bromide, silver iodobromide, a silver chloroiodo-bromide containing less than 10 mol% iodide and less than 30 mol% chloride is particularly preferred.

In this invention, a negative type silver halide emulsion forming surface latent image or a direct reversal silver halide emulsion can be used. As the latter type emulsion, there are an internal latent image-type silver halide emulsion and a pre-fogged direct reversal-type silver halide emulsion.

In this invention internal latent image-type silver halide emulsions are advantageously used, and examples of the emulsions of this type are conversion-type silver halide emulsions, core/shell-type silver halide emulsions, foreign metal-containing silver halide emulsions as disclosed in, for example, U.S. Pat. Nos. 2,592,250, 3,206,313, 3,447,927, 3,761,276 and 3,935,014, etc.

Typical examples of the nucleating agents for the silver halide emulsions of this type are the hydrazines as disclosed in U.S. Pat. Nos. 2,588,982 and 2,563,785; the hydrazines and hydrazones as disclosed in U.S. Pat. No. 3,227,552; the quaternary salt compounds as disclosed in British Pat. No. 1,283,835, Japanese Patent Publication No. 38164/74 and U.S. Pat. Nos. 4,115,122, 3,734,738, 3,719,494 and 3,615,615; the sensitizing dyes having nucleating substituents showing fogging action in the dye molecules as disclosed in U.S. Pat. No. 3,718,470;

and the thiourea-bound acylhydrazine series compounds as disclosed in U.S. Pat. Nos. 4,030,925, 4,031,127, 4,245,037, 4,255,511, 4,266,013 and 4,276,364, etc.

The silver halide emulsions used in this invention can have enlarged color sensitivity by spectral sensitizing dyes, if desired. Useful spectral sensitizing dyes include cyanine dyes, merocyanine dyes, etc.

The dye image-forming compound used in this invention is of a negative type or a positive type as known in the field of the art; that is, the compound is originally mobile or immobile in the photographic element containing the compound in the case of processing the photographic element with an alkaline processing composition.

Preferred negative-type dye image-forming compounds used in this invention include a coupler capable of releasing or forming a dye upon reaction with an oxidized color developing agent. Specific examples of the coupler are described in U.S. Pat. No. 3,227,550, Canadian Pat. No. 602,607, etc. A preferred negative-type dye image-forming compound used in this invention is a dye-releasing redox compound capable of releasing a dye upon reaction with a developing agent in an oxidized state or with an electron transfer agent. Typical examples of the compound are described in Japanese Patent Publication (Unexamined) Nos. 33826/73, 54021/79, 113624/76 and 71072/82, etc.

As the immobile positive type dye image-forming compound used in this invention, there is a compound releasing a diffusible dye without receiving electrons (i.e., without being reduced) or after receiving at least one electron (i.e., after being reduced) during the photographic processing under an alkaline condition. Typical examples of the compound are described in Japanese Patent Publication (Unexamined) Nos. 111628/74, 63618/76, 4819/77, 69033/78, 110827/78, 110828/78 and 130927/79.

Furthermore, as an effective positive type image-forming compound which is originally mobile under an alkaline photographic processing condition, there are dye developers, and typical examples are described in Japanese Patent Publication Nos. 32130/73 and 22780/80, etc.

The dye formed from the dye image-forming compound used in this invention may be a dye itself or a dye precursor which can be converted into a dye in a photographic processing step or an additional processing step, and further the final image dye may be metallized. As the typical dye structure useful in this invention, there are metallized or non-metallized dyes such as azo dyes, azomethine dyes, anthraquinone dyes, phthalocyanine dyes, etc. Of these dyes, azo series cyan, magenta and yellow dyes are particularly important.

Specific examples of the yellow dye image-forming compound used in this invention are described in Japanese Patent Publication No. 2618/74, U.S. Pat. No. 3,309,199; Japanese Patent Publication No. 12140/82, Japanese Patent Publication (Unexamined) Nos. 114930/76, 111344/79, 16130/81, 71072/81, 79031/79, 64036/78 and 23527/79, U.S. Pat. Nos. 4,148,641 and 4,148,643, and *Research Disclosure,* 17630 (1978), ibid., 16475 (1977).

Specific examples of the magenta dye image-forming compound are described in U.S. Pat. No. 3,453,107, Japanese Patent Publication No. 43950/71, Japanese Patent Publication (Unexamined) No. 106727/77, U.S. Pat. Nos. 3,932,380, 3,931,144 and 3,932,308, Japanese Patent Publication (Unexamined) Nos. 115528/75, 106727/77, 23628/78, 65034/79, 36804/80, 161332/79, 4028/80, 73057/81, 71060/81, 134/80 and 35533/78, and U.S. Pat. Nos. 4,207,104 and 4,287,292.

Specific examples of the cyan dye image-forming compound are described in Japanese Patent Publication No. 32130/73, Japanese Patent Publication (Unexamined) Nos. 8827/77, 126331/74, 109928/76, 99431/79, 149328/78, 47823/78, 143323/78, 99431/79, 71061/81, 64035/78 and 121125/79, U.S. Pat. Nos. 4,142,891, 4,195,994, 4,147,544 and 4,148,642, European Pat. Nos. 53,037 and 53,040, and *Research Disclosure,* 17630 (1978), ibid., 16475 (1975) and ibid., 16475 (1977).

The dye precursor used may be a dye-releasing redox compound having a dye moiety which temporarily shifts the light absorption in a photosensitive element. Specific examples of the redox compound are described in Japanese Patent Publication (Unexamined) Nos. 53330/80 and 53329/80, U.S. Pat. Nos. 3,336,287, 3,579,334 and 3,982,946, and British Patent 1,467,317.

When a dye-releasing redox compound is in processing the photographic elements of this invention, any silver halide developing agents may be used if these developing agents can cross-oxidize the aforesaid redox compound. Such a developing agent may be incorporated in an alkaline processing composition or may be incorporated in a proper layer of the photographic element. Specific examples of the developing agent used in this invention are hydroquinones, aminophenols, phenylenediamines, and pyrazolidinones (e.g., phenidone, 1-phenyl-3-pyrazolidinone, dimezone(1-phenyl-4,4-dimethyl-3-pyrazolidinone), 1-p-tolyl-4-methyl-4-oxymethyl-3-pyrazolidinone, 1-(4'-methoxyphenyl)-4-methyl-oxymethyl-3-pyrazolidinone, 1-phenyl-4-methyl-4-oxymethyl-3-pyrazolidinone, etc.), as disclosed in Japanese Patent Publication (Unexamined) No. 16131/81.

In the foregoing silver halide developing agents, black and white developing agents (in particular, pyrazolidinones) capable of further reducing the formation of stains in an image-receiving layer as compared to a color developing agent such as phenylenediamines are particularly preferred.

When other dye image-forming compounds than the dye-releasing redox compounds are used, an ordinary silver halide developing agent suitable for each dye image-forming compound can be used.

The processing composition used for processing the photographic elements of this invention contains a base such as sodium hydroxide, potassium hydroxide, sodium carbonate, sodium phosphate, etc., and it is proper that the processing composition has a pH of about 9 or higher, preferably 11.5 or higher. The processing composition may further contain an anti-oxidant such as sodium sulfite, an ascorbate, piperidinohexose reductone, etc., or a silver ion concentration controlling agent such as potassium bromide. Moreover, the processing composition may further contain a thickening compound such as hydroxyethyl cellulose, sodium carboxymethyl cellulose, etc.

Still further, the processing composition may contain a compound capable of promoting the development or the diffusion of a dye, such as benzyl alcohol.

For the reproduction of natural color by a substractive color process, a photographic material having at least two combinations of silver halide emulsions each having a selective spectral sensitivity in a certain wavelength region and dye image-forming compounds each having a selective spectral absorption in the same wavelength region.

In particular, a photographic material composed of a combination of a blue-sensitive silver halide emulsion and a yellow dye-releasing redox compound, a combination of a green-sensitive silver halide emulsion and a magenta dye-releasing redox compound, and a combination of a red-sensitive silver halide emulsion and a cyan dye-releasing redox compound is useful. These combination units of the silver halide emulsions and dye-releasing redox compounds may be coated in layers in face-to-face relationship in the photographic material or may be coated in layers as a mixture of particles (a dye-releasing redox compound and a silver halide grain exist in the same particle).

A scavenger for an oxidized developing agent can be used in various interlayers of the photographic elements of this invention. Suitable materials are described in *Research Disclosure,* Vol. 151, 76–79 (November, 1976).

In this invention, an insulating layer may be formed between the interlayer and the layer containing the dye image-forming compound as disclosed in Japanese Patent Publication (Unexamined) No. 52056/80. Also, a silver halide emulsion may be incorporated in the interlayer or interlayers as disclosed in Japanese Patent Publication (Unexamined) No. 67850/81.

The mordant layers, neutralizing layers, processing compositions, etc., as disclosed in, for example, Japanese Patent Publication (Unexamined) No. 64533/77, can be properly used for the color diffusion transfer photosensitive material of this invention.

The polymer mordant for the image-receiving layer used in this invention is a polymer containing a secondary or tertiary amino group, a polymer having a nitrogen-containing heterocyclic moiety, or a polymer having such a quaternary cation group. The polymer has a molecular weight higher than 5,000, preferably higher than 10,000.

Examples of the mordant used in this invention are vinylpyridine polymers and vinylpyridinium cation polymers as disclosed in U.S. Pat. Nos. 2,548,564, 2,484,430, 3,148,061 and 3,756,814, etc.; vinylimidazolium cation polymers as disclosed in U.S. Pat. No. 4,124,386, etc.; polymer mordants capable of crosslinking with gelatin, etc. as disclosed in U.S. Pat. Nos. 3,625,694, 3,859,096 and 4,128,538, British Pat. No. 1,277,453, etc.; aqueous sol-type mordants as disclosed in U.S. Pat. Nos. 3,958,995, 2,721,852 and 2,798,063, Japanese Patent Publication (Unexamined) Nos. 115228/79, 145529/79, 126027/79, 155835/79 and 17352/81, etc.; water-insoluble mordants as disclosed in U.S. Pat. No. 3,898,088, etc.; reactive mordants capable of making covalent bonding with dyes as disclosed in U.S. Pat. Nos. 4,168,976 and 4,201,840; and mordants as disclosed in U.S. Pat. Nos. 3,709,690, 3,788,855, 3,642,482, 3,488,706, 3,557,066, 3,271,147 and 3,271,148, Japanese Patent Publication (Unexamined) Nos. 30328/78, 155528/77, 125/78, 1024/78 and 107835/78, British Pat. No. 2,064,802, etc.

Further, mordants as disclosed in U.S. Pat. Nos. 2,675,316 and 2,882,156 may be also used in this invention.

As the image-receiving layer for mordanting an azo dye having a chelating group, a layer containing a polymer capable of immobilizing a transition metal ion and a transition metal ion in the mordant layer or a layer adjacent to the mordant layer is preferred. Examples of the polymer capable of immobilizing a transition metal ion are described in Japanese Patent Publication (Unexamined) Nos. 48210/80 and 129346/80, and U.S. Pat. Nos. 4,273,853 and 4,282,305.

The acidic polymers used for the neutralizing layers in this invention are as follows.

A preferred acidic material used as the acidic polymer is a material having an acidic group of less than pKa 9 (or a precursor group capable of providing an acidic group by hydrolysis), and preferred examples thereof are higher fatty acids such as oleinic acid as disclosed in U.S. Pat. No. 2,983,606; polymers of acrylic acid, methacrylic acid or maleic acid or partial esters or acid anhydride thereof as disclosed in U.S. Pat. No. 3,362,819; copolymers of acrylic acid and an acrylic acid ester as disclosed in French Pat. No. 2,290,699; and latex-type acidic polymer as disclosed in U.S. Pat. No. 4,139,383 and *Research Disclosure,* No. 16102 (1977).

Further, acidic materials as disclosed in U.S. Pat. No. 4,088,493, Japanese Patent Publication (Unexamined) Nos. 153739/77, 1023/78, 4540/78, 4541/78 and 4542/78, etc. may also be used.

Specific examples of the acidic polymer used in this invention are copolymers of ethylene or vinyl monomers such as vinyl acetate, vinyl methyl ether, etc. with maleic anhydride, or n-butyl half esters thereof, a copolymer of butyl acrylate and acrylic acid, cellulose acetate hydrogen phthalate, etc.

The invention will now be further explained practically by the following examples. However, the scope of the invention is not limited to these examples.

EXAMPLE 1

Cover sheet (A):

Cover sheet (A) was prepared by coating, in succession, the following layers on a polyethylene terephthalate support.

(1) A neutralizing layer prepared by coating a copolymer of acrylic acid and butyl acrylate (8:2 by mole ratio) having a mean molecular weight of 50,000 at a coverage of 22 g/m$^2$.

(2) A neutralization timing layer prepared by coating a mixture of cellulose acetate (the amount of acetic acid released by hydrolysis being 0.513 g per gram of the sample) having an acetylated degree of 51.3% and a copolymer of styrene and maleic anhydride (1:1 by mole ratio) having a mean molecular weight of about 10,000 at 95:5 by weight ratio at a coverage of 4.5 g/m$^2$.

(3) A layer prepared by blending a polymer latex prepared by emulsion polymerizing styrene, butyl acrylate, acrylic acid and N-methylolacrylamide at a weight ratio of 49.7/42.3/4/4 and a polymer latex prepared by emulsion polymerizing methyl methacrylate, acrylic acid and N-methylolacrylamide at a weight ratio of 93/3/4 so that the solid ratio became 6:4 and coating the blend thus obtained at a coverage of 1.6 g/m$^2$.

Cover sheets (B), (C), (D), and (E) were also prepared by the following manners.

Cover sheet (B):

Cover sheet (B) was prepared in the same manner as cover sheet (A) except that 2.6 mmols/m$^2$ of Compound 1 of this invention was added to the timing layer (2) of the cover sheet (A).

Cover sheet (C):

Cover sheet (C) was prepared in the same manner as cover sheet (A) except that 2.6 mmols/m$^2$ of 5-[2-(4-methoxyphenylsulfonyl)ethylthio]-1-phenyltetrazole as disclosed in Japanese Patent Publication (Unexamined)

No. 138745/80 was added to the timing layer (2) of the cover sheet (A) as comparison.

Cover sheet (D):

Cover sheet (D) was prepared in the same manner as cover sheet (A) except that 2.6 mmols/m$^2$ of 5-[2-(4-octadecyloxyphenylsulfonyl)ethylthio]-1-phenyltetrazole as disclosed in Japanese Patent Publication (Unexamined) No. 138745/80 was added to the timing layer (2) of the cover sheet (A) as comparison.

Cover sheet (E):

Cover sheet (E) was prepared in the same manner as cover sheet (A) except that 2.6 mmols/m$^2$ of 5-(2-cyano-1-methylethylthio)-1-phenyltetrazole as disclosed in Japanese Patent Publication (Unexamined) No. 130929/79 was added to the timing layer (2) of the cover sheet (A).

pH Indicator-coated film

A pH indicator-coated film was prepared by coating, in succession, the following layers on a transparent polyethylene terephthalate support.

(1) An indicator layer containing 0.2 g/m$^2$ of Thymolphthalein and 7 g/m$^2$ of gelatin.

(2) A white reflecting layer containing 20 g/m$^2$ of titanium oxide and 2 g/m$^2$ of gelatin.

(3) An indicator layer the same as indicator layer (1).

Processing solution

A processing composition having the following composition:

| | |
|---|---|
| Na salt of carboxymethyl cellulose | 40 g |
| Potassium hydroxide | 42 g |
| Water | 918 g |

The cover sheet as prepared above or the cover sheet further forcibly aged for 3 days under conditions of 50° C. and a relative humidity of 80% was placed on the foregoing pH indicator-coated film in a face-to-face relationship, and the foregoing processing solution was spread between them at a thickness of 80 microns. Then, the density measurement was performed from the side of the pH indicator-coated film to measure the time required for reducing the reflection density of the high pH color (blue) of Thymolphthalein to half by neutralization (the time is called "neutralization timing time") at 25° C. The results are shown in Table 1.

TABLE 1

| Cover Sheet | Neutralization Timing Time (a) Fresh | (b) 50° C., 80% 3 days | Δ(= (b) − (a)) |
|---|---|---|---|
| (A) | 4.9 min. | 6.5 min. | 1.6 min. |
| (B) | 5.5 min. | 7.0 min. | 1.5 min. |
| (C) | 10.6 min. | 17.2 min. | 6.6 min. |
| (D) | 5.7 min. | 20.1 min. | 14.4 min. |
| (E) | 7.4 min. | 9.0 min. | 1.6 min. |

The results of Table 1 show that in cover sheets (C) and (E), the neutralization timing time of fresh is substantially longer than that of control cover sheet (A), whereby the time that the system is exposed to high pH is longer than necessary. Such a phenomenon is undesirable since it reduces, for example, the sharpness of images. Also, in cover sheet (D), the neutralization timing time of fresh is not long but when the cover sheet is subjected to the forcible aging for 3 days at 50° C. and 80%, the timing time becomes substantially longer, which greatly reduces the stability of the cover sheet with the passage of time. On the other hand, it is understood that cover sheet (B) containing the compound of this invention does not show such undesirable tendencies and has excellent properties.

Thus, it is understood that when the compound of this invention is incorporated in a cover sheet, the stability of the cover sheet with the passage of time is greatly improved without reducing the pH controlling function of the cover sheet.

EXAMPLE 2

Photosensitive sheet (A):

Photosensitive sheet (A) was prepared by coating, in succession, the following layers.

(1) An image-receiving layer containing 3 g/m$^2$ of a polymer having the structure:

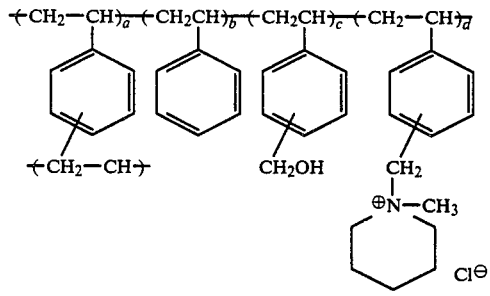

(a:b:c:d = 5:47.5:5.5:42)

3 g/m$^2$ of gelatin, and a coating aid of the structure:

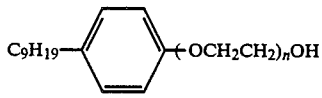

(n = about 30)

(2) A white reflecting layer containing 20 g/m$^2$ of titanium dioxide and 2.0 g/m$^2$ of gelatin.

(3) A light-shielding layer containing 2.0 g/m$^2$ of carbon black and 1.5 g/m$^2$ of gelatin.

(4) A layer containing 0.44 g/m$^2$ of a cyan dye-releasing redox compound having the following structure:

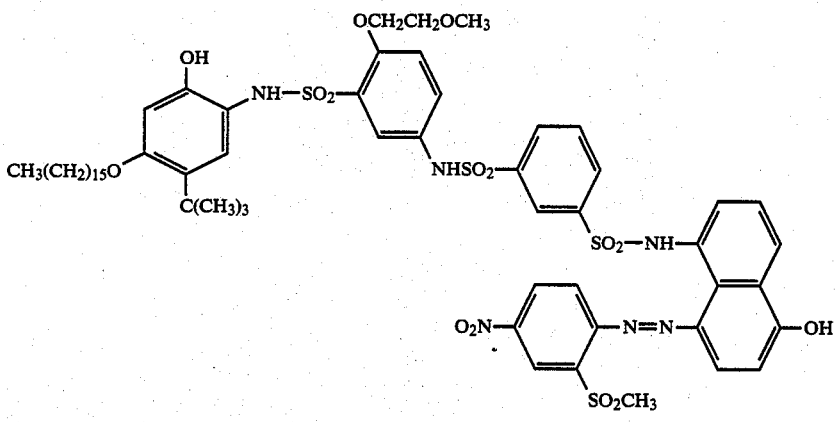

0.09 g/m² of tricyclohexyl phosphate, 0.008 g/m² of 2,5-di-t-pentadecylhydroquinone, and 0.8 g/m² of gelatin.

(5) A red-sensitive silver halide emulsion layer containing 1.03 g/m² (as a silver amount) of a red-sensitive internal latent image-type direct positive silver bromide emulsion, 1.2 g/m² of gelatin, 0.04 mg/m² of a nucleating agent having the following structure:

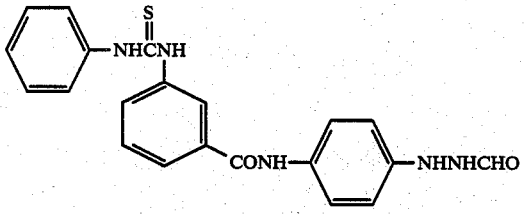

and 0.13 g/m² of 2-sulfo-5-n-pentadecylhydroquinone sodium salt.

(6) A layer containing 0.43 g/m² of 2,5-di-t-pentadecylhydroquinone, 0.1 g/m² of trihexyl phosphate, and 0.4 g/m² of gelatin.

(7) A layer containing 0.21 g/m² of a magenta dye-releasing redox compound having following structure (I), 0.11 g/m² of a magenta dye-releasing redox compound having following structure (II), 0.08 g/m² of tricyclohexyl phosphate, 0.009 g/m² of 2,5-di-t-pentadecylhydroquinone, and 0.9 g/m² of gelatin.

(I)

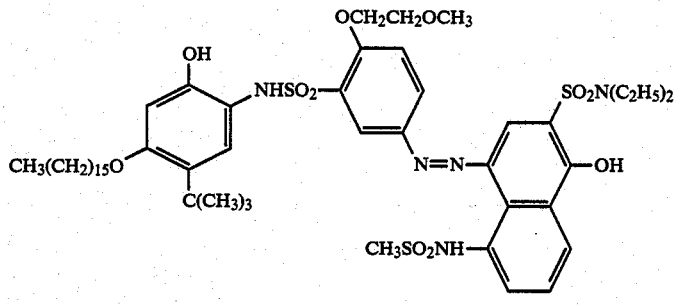

(II)

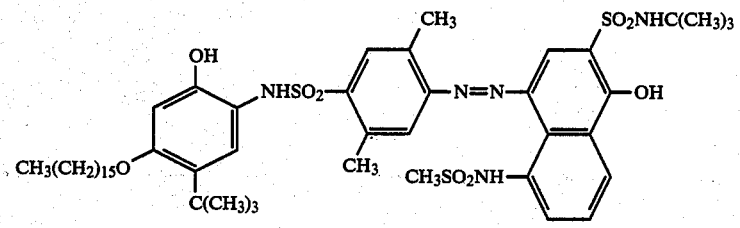

(8) A green-sensitive silver halide emulsion layer containing 0.82 g/m² (as a silver amount) of a green-sensitive internal latent image-type direct positive silver bromide emulsion, 0.9 g/m² of gelatin, 0.03 mg/m² of the nucleating agent having the same structure as that used in the layer (5), and 0.08 g/m² of 2-sulfo-5-n-pentadecylhydroquinone sodium salt.

(9) A layer having the same construction as that of the layer (6).

(10) A layer containing 0.53 g/m² of a yellow dye-releasing redox compound having the following structure:

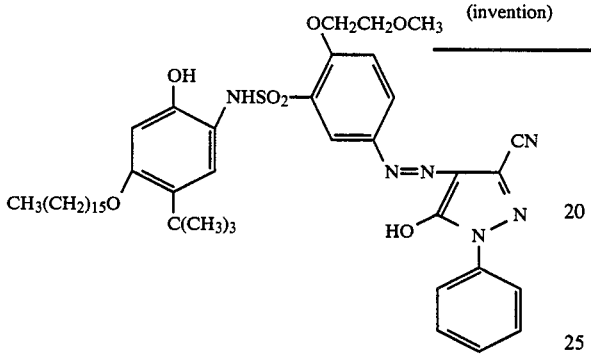

0.13 g/m$^2$ of tricyclohexyl phosphate, 0.014 g/m$^2$ of 2,5-di-t-pentadecylhydroquinone, and 0.7 g/m$^2$ of gelatin.

(11) A blue-sensitive silver halide emulsion layer containing 1.09 g/m$^2$ (as a silver amount) of a blue-sensitive internal latent image-type positive silver halide emulsion, 0.04 mg/m$^2$ of the nucleating agent as that used in the layer (5), 1.1 g/m$^2$ of gelatin, and 0.07 g/m$^2$ of 2-sulfo-5-n-pentadecylhydroquinone sodium salt.

(12) A layer containing 1.0 g/m$^2$ of gelatin.

Cover sheet:

Cover sheets (A) and (B) as used in Example 1 were used.

After exposing the foregoing photosensitive sheet (A) through a color test chart, the photosensitive sheet was placed on foregoing cover sheet (A) or (B), and a processing solution having the following composition was then spread between the sheets at a thickness of 85 microns by means of press rolls.

Processing solution:

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethyl cellulose sodium salt | 58 g |
| Potassium hydroxide (28% aq. solution) | 200 ml |
| Benzyl alcohol | 1.5 ml |
| Carbon black | 150 g |
| Water | 685 ml |

The processing was performed at 10° C., 25° C., and 35° C., respectively. The photographic properties of the color image obtained on each sheet after processing are shown in Table 2.

TABLE 2

| | Processing Temperature | Blue Dmax | Blue Dmin | Green Dmax | Green Dmin | Red Dmax | Red Dmin |
|---|---|---|---|---|---|---|---|
| Cover sheet (A) (control) | 10° C. | 1.62 | 0.24 | 1.57 | 0.21 | 1.80 | 0.33 |
| | 25° C. | 1.83 | 0.26 | 2.14 | 0.22 | 2.24 | 0.36 |
| | 35° C. | 1.90 | 0.31 | 2.20 | 0.25 | 2.30 | 0.45 |
| Cover sheet (B) (invention) | 10° C. | 1.70 | 0.22 | 1.68 | 0.20 | 1.96 | 0.32 |
| | 25° C. | 1.88 | 0.23 | 2.20 | 0.20 | 2.31 | 0.33 |
| | 35° C. | 1.90 | 0.24 | 2.20 | 0.22 | 2.29 | 0.36 |

As shown in Table 2, cover sheet (B) containing Compound 1 of this invention prevents the increase of Dmin in particular, at 35° C. as compared to control cover sheet (A) and gives a higher value than cover sheet (A) at 10° C.

Thus, it is clear that the cover sheet provided by the invention expands the allowable range of processing temperature in both the low temperature side and the high temperature side.

EXAMPLE 3

Photosensitive sheets (B) and (C) were prepared in the following manners.

Photosensitive sheet (B):

Photosensitive sheet (B) was prepared in the same manner as photosensitive sheet (A) except that 0.036 mmol/m$^2$ of Compound 1 was incorporated in the layer (2) of photosensitive sheet (A) together with 0.4 g/m$^2$ of tricyclohexyl phosphate and 0.4 g/m$^2$ of di-tert-hexylhydroxyanisole.

Photosensitive sheet (C):

Photosensitive sheet (C) was prepared in the same manner as photosensitive sheet (A) except that 0.4 g/m$^2$ of tricyclohexyl phosphate and 0.4 g/m$^2$ of di-tert-hexylhydroxyanisole were incorporated in the layer (2) of photosensitive sheet (A).

As a cover sheet, cover sheet (A) as used in Example 1 was used, and as a processing solution, the processing solution as used in Example 2 was used, respectively. The processing solution was spread as in Example 2. In this case, however, the processing temperature was 25° C. and 35° C., respectively.

Photographic properties of each color positive image obtained after processing are shown in Table 3.

TABLE 3

| | Processing Temperature | Blue Dmax | Blue Dmin | Green Dmax | Green Dmin | Red Dmax | Red Dmin |
|---|---|---|---|---|---|---|---|
| Photosensitive sheet (C) (control) | 25° C. | 1.74 | 0.22 | 2.16 | 0.24 | 2.16 | 0.36 |
| | 35° C. | 1.81 | 0.28 | 2.18 | 0.27 | 2.18 | 0.45 |
| Photosensitive sheet (B) (invention) | 25° C. | 1.79 | 0.22 | 2.26 | 0.23 | 2.40 | 0.34 |
| | 35° C. | 1.83 | 0.23 | 2.21 | 0.25 | 2.38 | 0.39 |

As shown in Table 3, it is understood that photosensitive sheet (B) containing Compound 1 of this invention inhibits the increase of Dmin in particular, at 35° C. as compared to control photosensitive sheet (C) and further that it increases the Dmax.

Thus, when the compound of this invention is incorporated in a photosensitive element, the compound exhibits remarkable effects and greatly contributes to the prevention of the occurrence of "fog" in particular, at high temperatures.

EXAMPLE 4

Photosensitive sheet:

Photosensitive sheet (A) as used in Example 2 was used.

Cover sheet:

Cover sheets (A), (B), and (C) as used in Example 1 and cover sheet (F) described hereinafter were used.

Cover sheet (F):

Cover sheet (F) was prepared in the same manner as cover sheet (A) except that 2.6 mmols/$m^2$ of 5-(2-cyanoethylthio)-1-phenyltetrazole as disclosed in Japanese Patent Publication No. 34927/80 was added to the timing layer (2) of cover sheet (A).

Processing solution:

The processing solution as used in Example 2 was used.

Processing step:

After exposing the photosensitive sheet, foregoing cover sheet (A), (B), (C), or (F) was placed on the photosensitive sheet, and the processing solution was applied as in Example 2. The processing was performed at 25° C. In each of the cover sheets a good color image was obtained.

Fading test:

After being allowed to stand for one day, the film units thus processed were allowed to stand in a closed heating vessel of 40° C. in the presence of silica gel for 7 days. After measuring the density of the samples, the samples were further allowed to stand for 14 days in the same vessel at 50° C. in the presence of an aqueous glycerol solution providing a relatively humidity of 70° C. Thereafter, the density of the samples was measured again. The density changes in Dmin portions and Dmax portions of each sample are shown in Table 4.

TABLE 4

| | Blue density | | Green density | | Red Density | |
|---|---|---|---|---|---|---|
| | ΔDmax | ΔDmin | ΔDmax | ΔDmin | ΔDmax | ΔDmin |
| Cover sheet (A) (control) | ±0 | +0.08 | −0.01 | +0.13 | +0.02 | +0.14 |
| Cover sheet (B) (invention) | ±0 | +0.11 | −0.02 | +0.12 | ±0 | +0.10 |
| Cover sheet (C) (comparison) | +0.02 | +0.16 | −0.06 | +0.22 | ±0 | +0.15 |
| Cover sheet (F) (comparison) | +0.02 | +0.09 | −0.14 | +0.08 | ±0 | +0.10 |

As shown in Table 4, it is understood that the development inhibitor precursor of this invention causes less of an increase in the density of the Dmin portion as compared to the precursor as disclosed in Japanese Patent Publication (Unexamined) No. 138745/80 which is used in cover sheet (C) and causes substantially less reduction of the Dmax portion of the green density as compared to that as disclosed in Japanese Patent Publication No. 34927/80 which is used to cover sheet (F).

While the invention has been described in detail and with reference to specific embodiments thereof, it will be apparent to one skilled in the art that various changes and modifications can be made therein without departing from the spirit and scope thereof.

What is claimed is:

1. A photographic element comprising a support having provided thereon at least one photosensitive silver halide emulsion layer, said photographic element containing a development inhibitor precursor represented by the following formula (II):

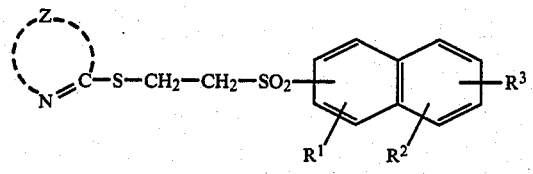

(II)

wherein Z represents a non-metallic atomic group necessary for completing an unsubstituted phenyltetrazole ring; $R^1$, $R^2$, and $R^3$, which may be the same or different, independently represent a hydrogen atom or a monovalent substituent with proviso that the total carbon atom number included in $R^1$, $R^2$, and $R^3$ is at least 4 and the moiety constituted by $R^1$, $R^2$, $R^3$ and the naphthalene ring is one for imparting a non-diffusable property to the compound of general formula (II) or the residual portion of the compound formed when the compound is split by development to release a silver halide development inhibitor, before and after the development.

2. A photographic element as claimed in claim 1, wherein the element is a color diffusion transfer photographic element.

3. A photographic element as claimed in claim 2, further comprising:

a dye image-forming compound associated with the emulsion layer, an image-receiving element for fixing a diffusible dye formed from the dye image-forming compound to form an image;

an alkaline processing composition capable of developing the exposed photosensitive element; and a neutralizing means for neutralizing the alkaline processing composition.

4. A photographic element as claimed in claim 2, wherein the color diffusion transfer photographic element comprises:

a photosensitive sheet comprising a transparent support having provided thereon an image-receiving element for fixing a diffusible dye to form an image, a white reflecting layer, a light-shielding layer, and a photosensitive element including at least one silver halide emulsion layer and a dye image-forming compound associated therewith;

an alkaline processing composition capable of developing the exposed photosensitive element; and a cover sheet comprising another support having provided thereon a neutralizing means for neutralizing the alkaline processing composition.

5. A photographic element as claimed in claim 4, wherein the development inhibitor precursor is incorporated in the cover sheet.

6. A photographic element as claimed in claim 5, wherein the silver halide emulsion layer is an internal latent image-type direct positive silver halide emulsion layer.

7. A photographic element as claimed in claim 6, wherein the dye image-forming compound associated with the internal latent image-type direct positive silver halide emulsion layer is a dye-releasing redox compound.

8. A photographic element as claimed in claim 1, wherein the development inhibitor precursor is present in an amount of at least $10^{-5}$ mol per mol of silver.

9. A photographic element as claimed in claim 8, wherein the development inhibitor precursor is present in an amount in the range of $10^{-4}$ to $10^{-1}$ mol per mol of silver.

* * * * *